United States Patent [19]

Sander

[11] 4,136,760

[45] Jan. 30, 1979

[54] CLASP BRAKE RIGGING FOR A RAILWAY VEHICLE

[75] Inventor: Nils B. L. Sander, Malmo, Sweden

[73] Assignee: SAB Industri AB, Malmo, Sweden

[21] Appl. No.: 820,612

[22] Filed: Aug. 1, 1977

Related U.S. Application Data

[63] Continuation of Ser. No. 733,305, Oct. 18, 1976, which is a continuation of Ser. No. 631,637, Nov. 13, 1975, abandoned.

[30] Foreign Application Priority Data

Nov. 15, 1974 [SE] Sweden ..... 7414357

[51] Int. Cl.[2] ..... F16D 65/52

[52] U.S. Cl. ..... 188/198; 188/56

[58] Field of Search ..... 188/196 BA, 198, 199, 188/200, 202, 203, 56, 75

[56] References Cited

U.S. PATENT DOCUMENTS 3,613,840 10/1971 Touchstone ..... 188/56 X 3,624,766 11/1971 Sander ..... 188/202

FOREIGN PATENT DOCUMENTS 382125 10/1932 United Kingdom ..... 188/202

*Primary Examiner*—George E. A. Halvosa

*Attorney, Agent, or Firm*—Laurence R. Brown

[57] ABSTRACT

A clasp brake rigging is provided with an axially acting brake regulator coupled between a pivotable control lever and a rigging pull rod opposite the dead brake lever. The control lever at an intermediate position is coupled by an adjustable length link to the live brake lever at the coupling position with its brake block assembly.

1 Claim, 2 Drawing Figures

CLASP BRAKE RIGGING FOR A RAILWAY VEHICLE

This application is a continuation of U.S. patent application Ser. No. 733,305, filed Oct. 18, 1976, now abandoned, which in turn is a continuation of U.S. patent application Ser. No. 631,637, filed Nov. 13, 1975, now abandoned.

This invention relates to a clasp brake rigging for a railway vehicle, including a live brake lever, which is actuated at its upper end by the force from a stationary brake cylinder and is connected to a first brake block; a dead brake lever, which is suspended from the vehicle underframe and is connected to a second brake block; a pull rod, which extends between the lower ends of the said two brake levers and is pivotally attached to the dead brake lever; and an axially acting brake regulator, which is connected to the lower end of the live brake lever as well as the pull rod.

In such a brake rigging it is difficult to obtain a simple and reliable control arrangement for the brake regulator.

This problem is according to the invention solved in that there is a control lever, which is suspended from the vehicle underframe, is arranged to actuate a control sleeve of the brake regulator, and is connected to the live brake lever at the connection point of the same to the first brake block.

It is necessary to set the control lever in a proper position relative to the brake rigging in order to obtain the proper function of the regulator, which is to keep the slack between the brake blocks and the wheel at a predetermined value. This is attained in that a connecting rod between the control lever and the connection point of the live brake lever to the first brake block is of adjustable length.

Figure 1:
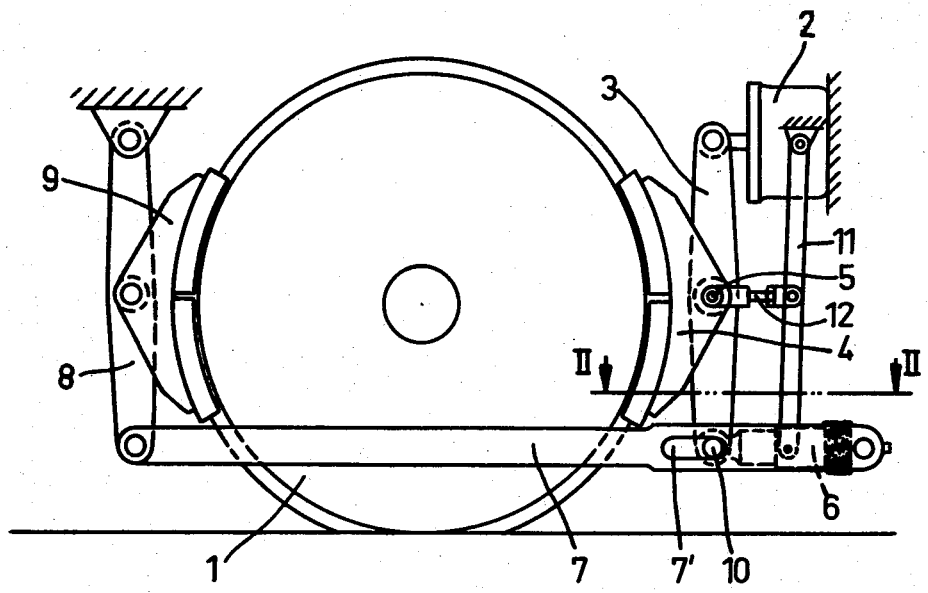
Figure 2:
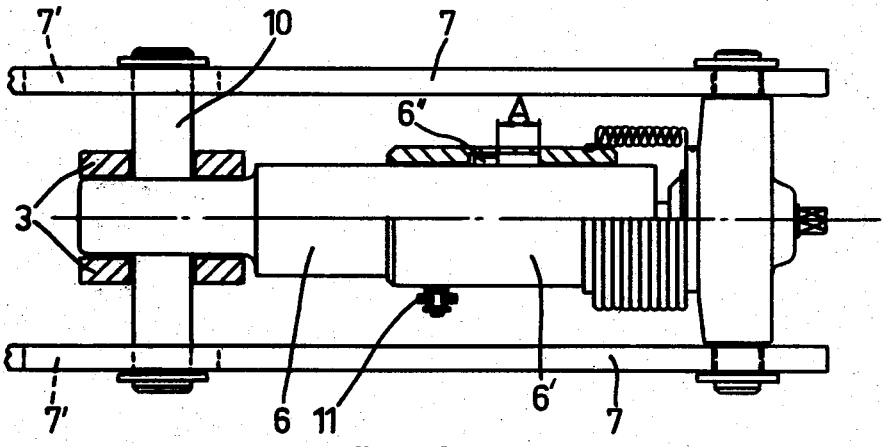

The invention will be described in further detail below, reference being made to the accompanying drawing, in which FIG. 1 is a side view of a clasp brake rigging according to the invention, and FIG. 2 is a partly sectional view substantially along the line II—II in FIG. 1.

A clasp brake rigging for a railway vehicle wheel 1 is to be actuated by the force from a brake cylinder 2 stationary to the vehicle underframe. A live brake lever 3, or rather a pair of brake levers, is pivotally attached to the push rod of the brake cylinder 2. A first brake block 4 is pivotally connected to the live brake lever 3 at a connection point 5.

The lower end of the live brake lever 3 is pivotally connected to one end of a brake regulator 6, which is axially acting and may be of any conventional type known per se but which is not illustrated in detail. In the preferred embodiment the brake regulator is single-acting and rapid-acting. The other end of the brake regulator 6 is connected to a pull rod 7, or rather a pair of pull rods, extending past the wheel 1 to a dead brake lever 8, which is suspended from the vehicle underframe. A second brake block 9 is pivotally connected to the dead brake lever 8.

A pivot 10 connecting the live brake lever 3 to the brake regulator 6 extends through slots 7' in the pull rods 7, so that at a brake application a pulling force may be transmitted from the live brake lever 3 to the pull rods 7 via the brake regulator 6, the latter being guided by the said pivot in the said slots.

It is evident that the brake regulator 6 needs a control arrangement for determining when the slack between the brake blocks 4, 9 and the wheel 1 exceeds a predetermined value. For this purpose a control lever 11 is suspended from the vehicle underframe at the brake cylinder 2 and is pivotally connected to an axially movable control sleeve 6' of the brake regulator 6. A control distance A is formed between a shoulder in the sleeve 6' and a control pin 6'' controlling the regulator mechanism. A connecting rod 12 with adjustable length is arranged between the connection point 5 and the control lever 11. The ratio between the parts of the control lever 11 on either side of the connecting rod 12 corresponds to the ratio between the parts of the live brake lever 3 on either side of the connection point 5.

It will be readily understood that the brake rigging shown in FIG. 1 as described above will operate in the manner of a conventional brake rigging of the kind referred to, but in accordance with the invention, brake regulator 6 is included in an automatic push-transmitting slack adjuster which is mounted between a pair of pull rods 7 while being adjustable at one location by means of slots 7' and being fixed near the edge of the push rods at a second location.

Slack adjustment is effected by the further requirement of control lever 11. When brake cylinder 2 forces live brake lever 3 to an extended position to the left of FIG. 1 by reason of brake wear, connecting rod 12 having an adjustable length although fixed in operation, also causes the control lever 11 to move toward the left in FIG. 1. At the lower edge, control lever 11 being fixed to the control sleeve 6' causes the sleeve also to move toward the left in FIG. 1 and within the area of slot 7'. This movement carries a new fixed point 10 toward the left in FIG. 1 which takes up the slack caused by wear of the brakes. The new fixed point permits operation of the live brake lever 3 as originally positioned except for the change caused by wear.

With the described control arrangement it is possible to obtain a proper function of the brake regulator 6 at the wearing of the brake blocks 4, 9.

The general braking action attained by the known clasp type brake rigging employed herein is well known. Thus, as brake cylinder 2 pushes its rod outwardly brake block 4 by pivot connection 5 is caused to contact wheel 1 and simultaneously the bottom pivot 10 moves pull rod 7 to the right causing brake block 9 to contact wheel 1.

The sleeve 6' of brake regulator 6 operates as in my U.S. Pat. No. 3,624,766 in response to the movement of control lever 11 over the control distance A to lengthen regulator 6 between brake lever 3 and the pivot connection on pull rod 7 as the brake blocks wear. This causes brake shoes 4 and 9 to come closer together. If the piston stroke tends to become longer because of brake wear, control lever 11 will be pulled by link 12 to the left moving sleeve 6' with it to the left to move the brake blocks 4 and 9 closer together, thereby reducing the piston stroke necessary for braking.

As before mentioned herein, to set the slack in the rigging at a predetermined value the connecting rod 12 may be adjusted.

This control system is simpler using less parts than shown in my aforementioned U.S. Patent, for example.

Modifications are possible within the scope of the appended claims. For example, the control lever may be pivoted around the connection point, and in such a case a connecting bar with adjustable length is to be arranged between the lower end of the control lever and the control sleeve of the brake regulator.

What is claimed is:

1. A clasp brake rigging for a railway vehicle comprising in combination, a first brake block, a live brake lever pivoted at an intermediate position to said first brake block, a piston applying force to one end of said brake lever, a second brake block, a dead brake lever suspended at one end from framework on said vehicle and pivoted on said second brake block at an intermediate position, a pull rod pivotally attached to the remaining end of said dead brake lever and having slotted guides intermediate the ends thereof, an axially acting brake regulator having a longitudinal body with two opposing ends and a separate connection to a control sleeve movable thereon to control the regulator mechanism, said regulator being coupled at one end of the body to the opposite end of said pull rod and slidably linked at the other end of the body at an intermediate position on said pull rod for limited movement in said slotted guides of said pull rod, the remaining end of said live brake lever at its end opposite the piston being slidably linked to said pull rod in said slotted guides, the other end of the body being pivotally coupled to the remaining end of the live brake lever to transmit a pulling force from the live brake lever to the pull rod via the brake regulator, and a control mechanism for said brake regulator determining when the slack exceeds a predetermined value consisting of a straight control lever arm having one end pivoted on the framework of said vehicle and having the remaining end connected directly to said movable control sleeve of said brake regulator, and a link on an intermediate position of said control lever arm connecting it to the junction of said first brake block and said live brake lever.

* * * * *